United States Patent [19]

Mackal et al.

[11] Patent Number: 4,498,605

[45] Date of Patent: Feb. 12, 1985

[54] AUTOMATIC INFLATOR

[75] Inventors: Glenn H. Mackal, St. Petersburg; John S. TenBarge, Clearwater, both of Fla.

[73] Assignee: Halkey-Roberts Corporation, St. Petersburg, Fla.

[21] Appl. No.: 402,918

[22] Filed: Jul. 29, 1982

[51] Int. Cl.[3] ..... B67B 7/24

[52] U.S. Cl. ..... 222/5; 222/54; 441/95

[58] Field of Search ..... 222/5, 54, 81, 83.5, 222/543, 3; 441/41, 92, 93, 95; 141/10, 19, 114, 313, 329, 330

[56] References Cited

U.S. PATENT DOCUMENTS

| | | | |
|---|---|---|---|
| 2,574,028 | 11/1951 | Fields et al. | 222/5 |
| 2,722,342 | 11/1955 | Fox | 222/54 X |
| 2,786,599 | 3/1957 | Higbee | 222/54 X |
| 3,596,799 | 12/1969 | Fairchild et al. | 222/5 |
| 4,260,075 | 4/1981 | Mackal | 222/5 |

*Primary Examiner*—Joseph J. Rolla
*Assistant Examiner*—Kevin P. Shaver

[57] ABSTRACT

An automatic inflator which inflates gas-inflatable articles by the release of compressed gas from a gas-containing capsule by the piercing of a seal on the capsule. The inflator has an elongated housing having first and second end portions, the housing receiving the neck of a compressed gas-containing capsule mounted for longitudinal movement with respect thereto and with the seal on the capsule disposed adjacent the second end portion of the housing. A piercing pin is mounted on the first end portion of the housing to confront the seal on the neck of a capsule mounted therein, there being a spring at the second end portion of the housing for constantly urging the capsule longitudinally of the housing toward the first end portion thereof. A releasable blocking device is disposed within the housing to hold the seal of the capsule spaced from the piercing pin, the blocking device including a water-sensitive element which when wet releases the blocking device so that the spring moves the capsule toward the piercing pin whereby the seal of the capsule is pierced thereby. The inflator is also provided with a selectively withdrawable abutment for the blocking device, whereby the capsule seal may be pierced manually.

10 Claims, 7 Drawing Figures

AUTOMATIC INFLATOR

This invention is related to those of Glenn H. Mackal which are disclosed in U.S. Pat. No. 4,223,805, Sept. 23, 1980; No. 4,260,075, Apr. 7, 1981; and No. 4,267,944, May 19, 1981.

This invention relates to an automatic inflator for inflatable articles such as life rafts, life vests, and the like. In the disclosed preferred embodiment thereof, the inflator is capable of operation both manually and automatically, the inflator in the latter mode of operation being operated automatically upon its subjection to water, as by being submerged therein when employed with a life vest worn by a ditching or parachuting aviator.

Automatic inflators have been previously proposed. Among such prior disclosed automatic inflators are the following: Muller, U.S. Pat. No. 1,329,990, Spidy, U.S. Pat. No. 2,894,658, Waters, U.S. Pat. No. 3,242,514, Fujimoto, U.S. Pat. No. 3,494,506, and Niemann, U.S. Pat. No. 3,997,079. Of these patents, only those to Fujimoto and Niemann disclose automatic inflators which are also capable of operation manually. In Fujimoto a lever-operated cam, an automatic, water-responsive mechanism, and a gas capsule which is moved toward a stationary piercing pin are arranged in that order. The operation of the inflator manually by the lever-operated cam may well cause operation of the automatic inflator portion of the device, a result which is neither necessary nor desirable. In Niemann, although the automatically operating portion of the device is disposed in series in that order with the manually operating portion thereof and the piercing pin, a part of the automatically operating mechanism is disposed in a first, removable part of the housing and another part of the automatically operating mechanism is disposed in a second part of the housing, and remains therein when the first part of the housing is removed and the inflator is operated only manually. Further, the removal of the first housing part leaves the second housing part in open condition, vulnerable to its being fouled both by physical and atmospheric agencies.

The above three referred-to Mackal patents have overcome to a substantial extent the outlined disadvantages of the prior art, and have provided an automatically operated mechanism, responsive to being immersed in water, to effect a piercing of a gas-containing capsule, which may be easily attached to and held securely as a part of a manually operable inflator which by itself is complete. The inflator of the present invention represents an improvement, not only over the above-noted prior art of others, but also over the invention of the prior Mackal patents. The inflator of the present invention is of simpler, more compact construction than prior inflators, is more economically made, and is more simply manipulated when operated in its manual mode. The gas-containing capsule is not limited in size, because only the neck thereof is contained within the housing of the inflator. The moisture-responsive latching mechanism which makes the automatic operation of the inflator possible is readily replaceable; the inflator has a good $CO_2$ seal; and the fact that the inflator has been manually operated is readily ascertainable from the fact that the manual firing mechanism, in the nature of an insertable fork, will have been removed from the inflator. Finally, the inflator of the invention is so constructed that it permits the fact that the inflator has been automatically operated to be quickly and accurately ascertained from the external appearance of the inflator.

The invention will be more readily understood upon consideration of the accompanying drawings, in which.

Figure 7:
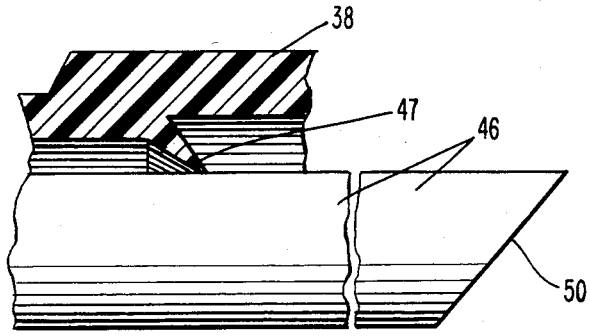
FIG. 7 is a fragmentary view in axial section on an enlarged scale of the seal between the piercing pin and the sleeve member disposed about a portion of the piercing pin.
Figure 1:
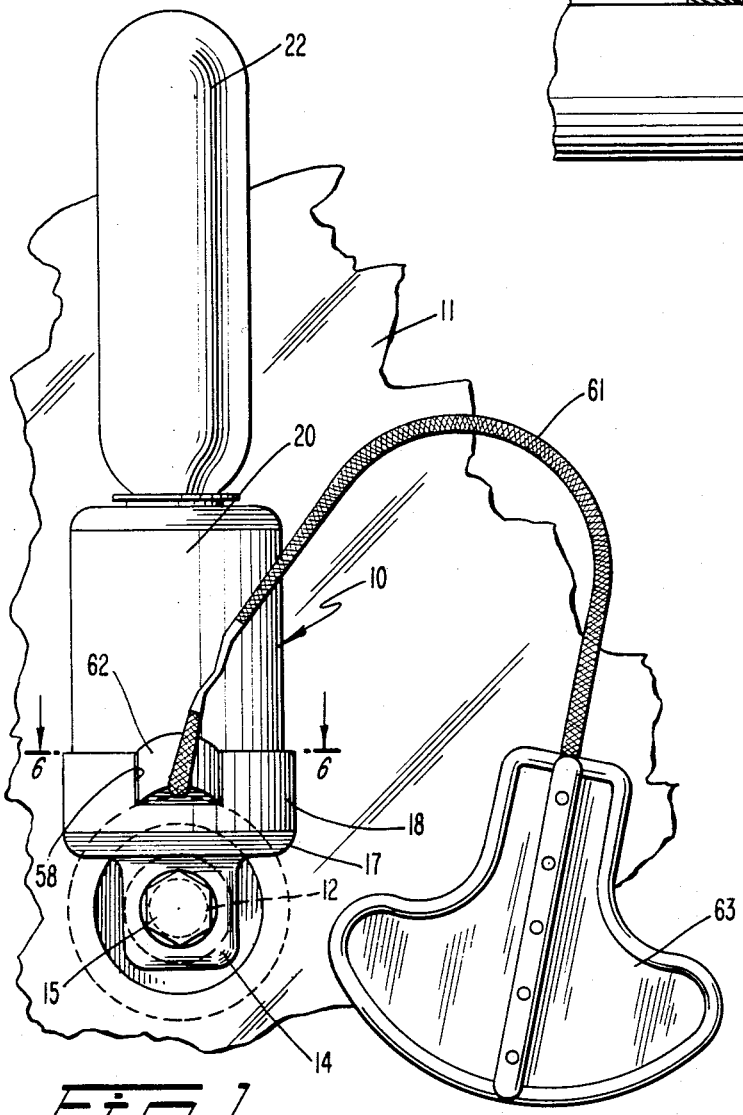
FIG. 1 is a view in side elevation of a preferred embodiment of the automatic inflator of the invention, such inflator being shown attached to a portion of the wall of an inflatable article.

FIG. 1 shows a preferred embodiment of inflator 10 in accordance with the invention, the inflator being attached and sealed to the side wall 11 of an inflatable article by means of a stem 12 which is received within a cylindrical bore 13 in an end enlargement or fitting 14 on the housing of the inflator. The stem 12 is secured and sealed to the part 14 of the housing by means including a sealing washer and a cap nut 15. The part or fitting 14 is formed integral with the left hand end member 17 of the housing of the inflator, such housing being composed of part 17 which has an internally threaded rearwardly (right) open skirt 18, skirt 18 threadedly receiving the externally threaded front end 19 of a second, rear housing member 20. The rear or right hand end of the housing part 20 is generally open, except for a shallow radially inwardly extending annular flange 66 on the rear end thereof. The externally threaded neck 21 of a $CO_2$ capsule 22 extends into and is secured in such rear end of the inflator.

Specifically, as shown in FIGS. 2–5 incl., neck 21 of the $CO_2$ capsule is screwed into the internally threaded rear end portion 23 of an elongated bobbin retainer 24 which is mounted within the housing part 20 coaxial thereof. The forward or left hand portion 25 of the bobbin retainer 24 has a diameter somewhat exceeding the external diameter of the portion 23 thereof. Part 24 is externally threaded as shown. The part 25 is screwed into and is supported by an internally threaded sleeve 26, the threaded connection between parts 25 and 26 being indicated at 27. Supporting sleeve 26 is mounted for reciprocation longitudinally of the housing part 20 while being prevented from rotation with respect thereto by spline means made up of grooves 29 in housing part 20 and interfitting lands 30 on the sleeve 26. It will be apparent that when the bobbin retainer 24 is rotated, as by using a $CO_2$ capsule 22 screwed into sleeve portion 23 as a handle, the supporting sleeve 26 moves longitudinally of the housing part 20 in one or the other direction, depending upon the direction of turning of the bobbin retainer.

A bobbin or latching member 31 is mounted within the front portion 25 of the bobbin retainer 24. Bobbin 31 is constructed in a manner which is generally similar to that of the latching means 61 disclosed in Mackal U.S. Pat. No. 4,260,075. Thus a plurality of angularly spaced fingers or segments 34 extend rearwardly from an annular body 32 thereof, each of fingers 34 having a radially inwardly extending tooth 35 thereon, the teeth 35 being transversely aligned. The forward left hand end surface of body 32 is designated 33. A water-disintegrable annular member 36 surrounds the fingers 34 and maintains the fingers in the position thereof shown in FIGS. 2, 3, and 4 until it is disintegrated upon contact with water, whereupon the fingers 34 spread as shown in FIG. 5, to be described hereinafter.

Figure 2:
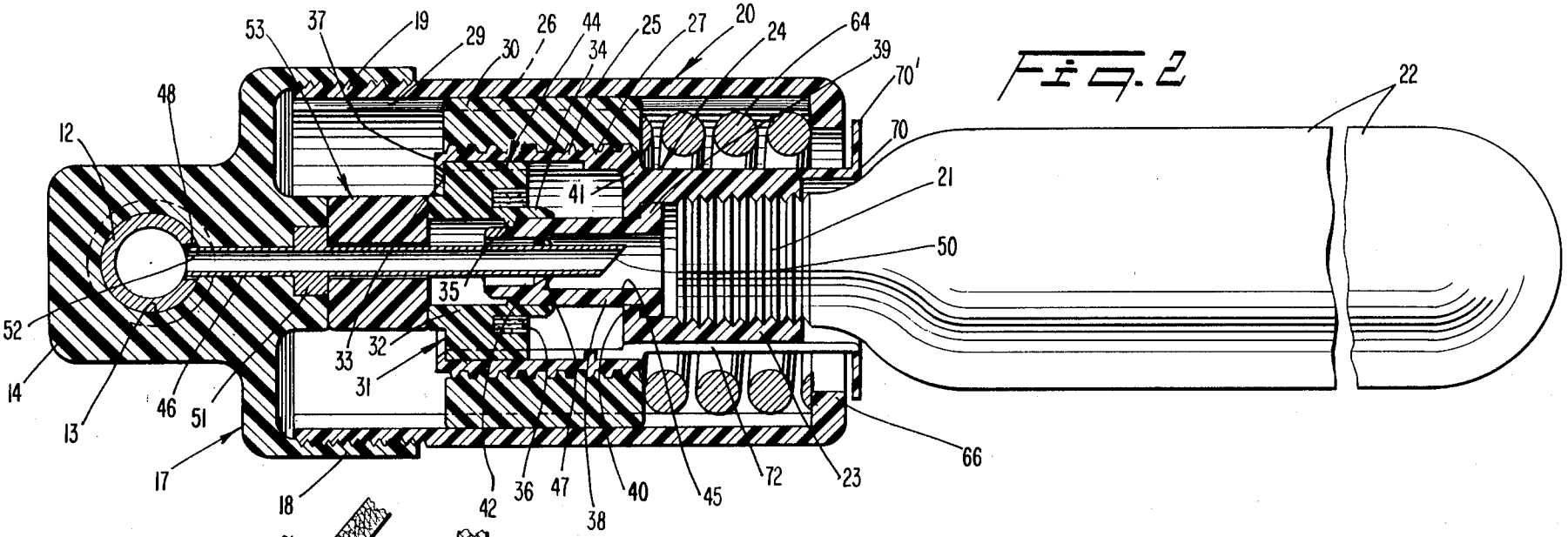
FIG. 2 is a view in longitudinal section on an enlarged scale through the inflator of FIG. 1, the section being taken along a plane parallel to the paper in FIG. 1.
Figure 3:
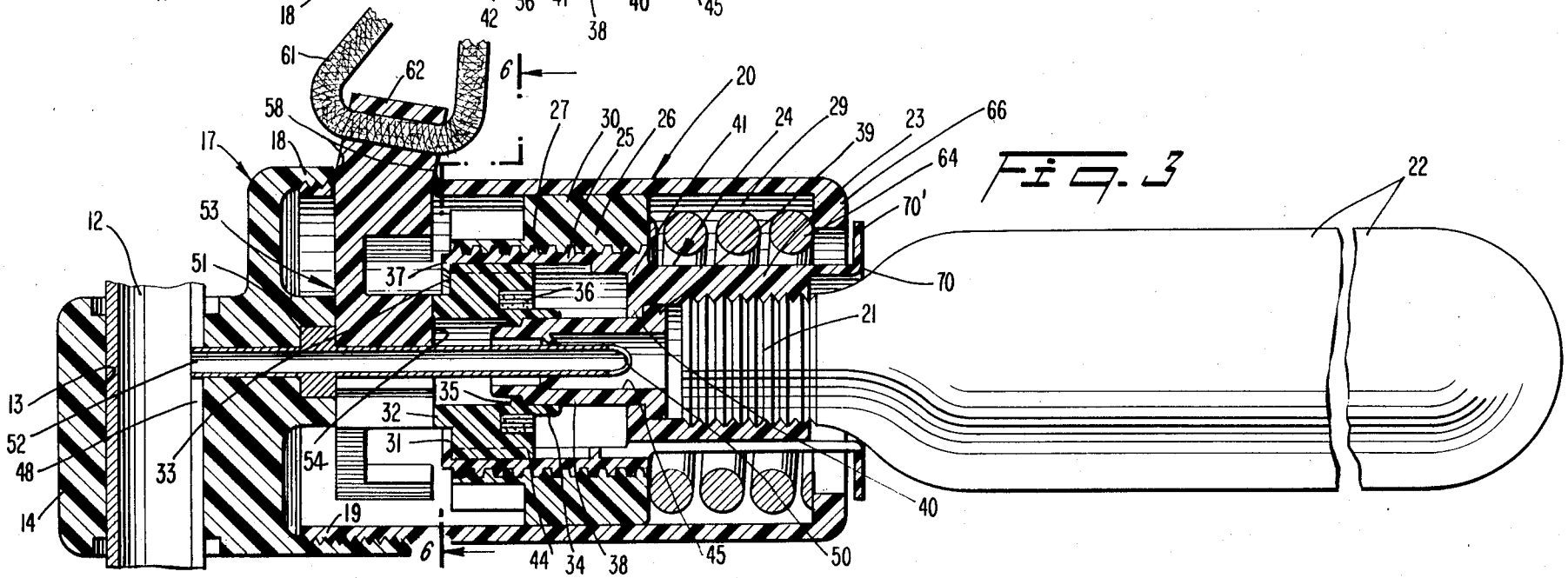
FIG. 3 is a view similar to FIG. 2 but with the sectioning plane displaced 90° about the axis of the inflator from that of FIG. 2.
Figure 4:
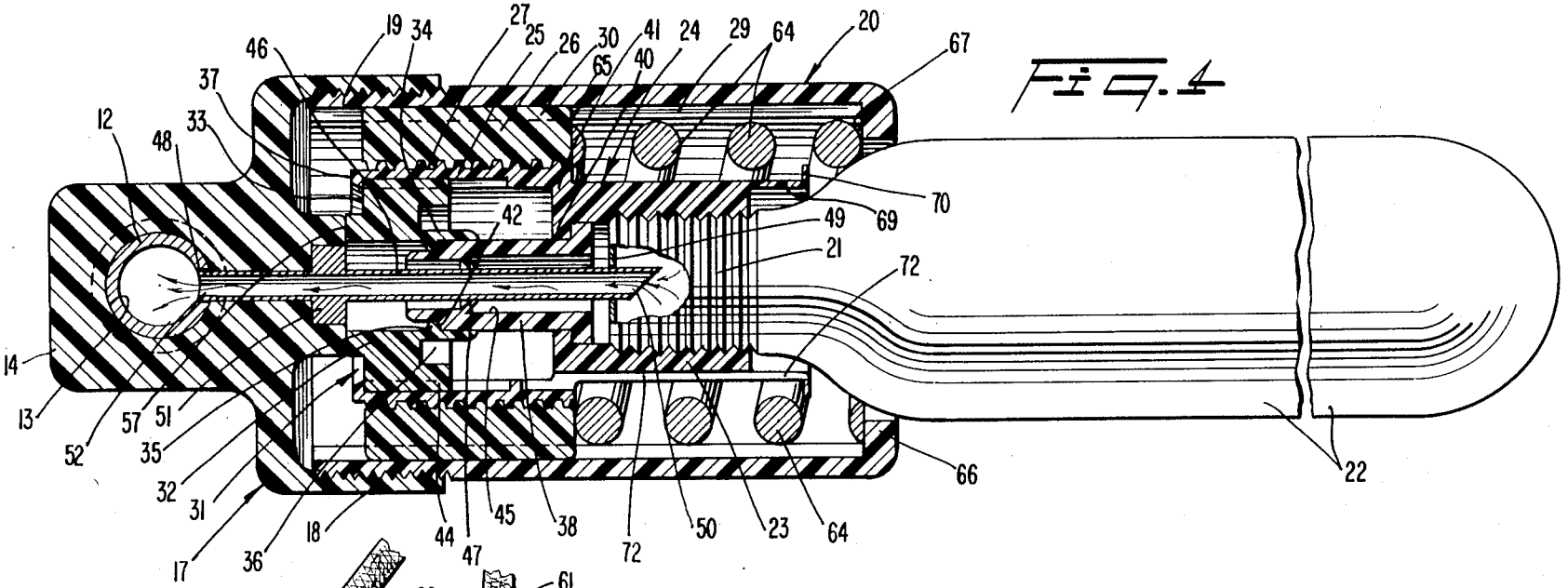
FIG. 4 is a view in longitudinal axial section through the inflator taken in a manner similar to that of FIG. 2, the inflator being shown in FIG. 4 in the condition which it assumes after having been manually operated or discharged.
Figure 5:
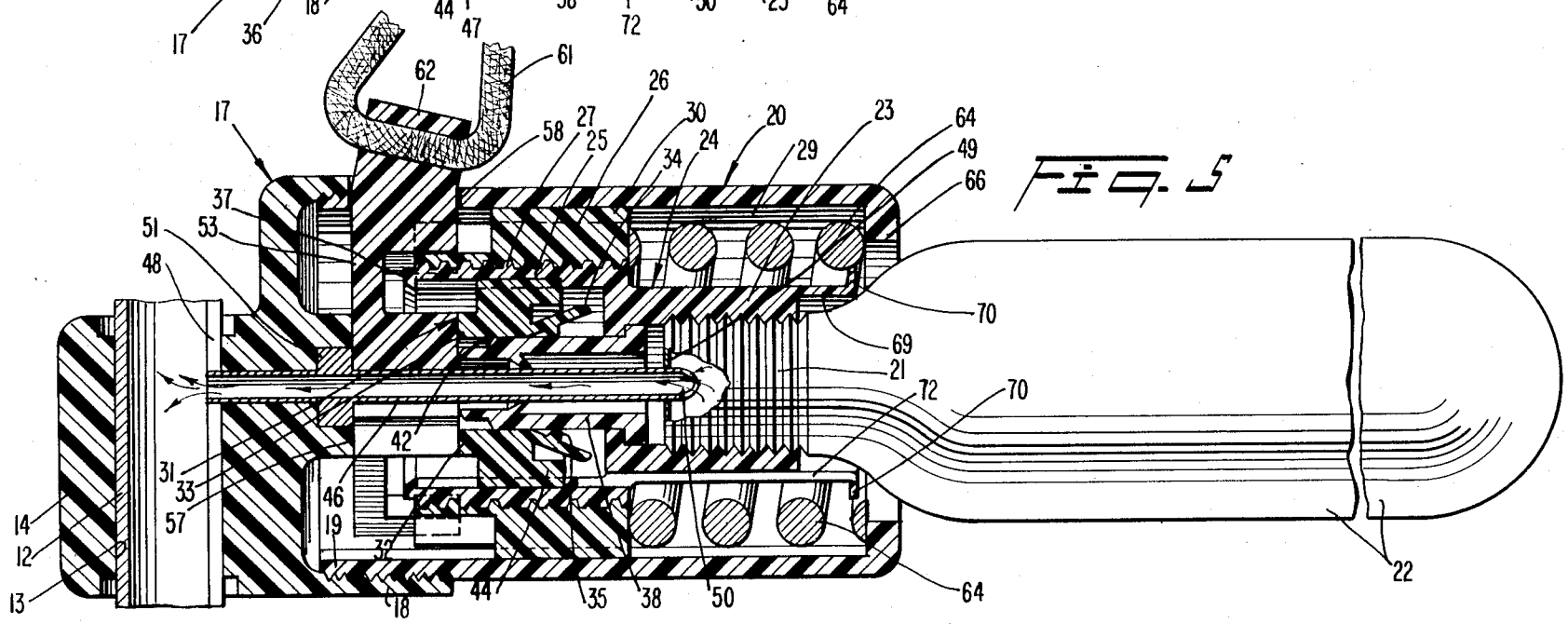
FIG. 5 is a view similar to FIG. 3 but with the inflator in the condition which it assumes after it has been automatically fired or discharged.

The bobbin or latching means 31 in the position thereof shown in FIGS. 2, 3, and 4 is disposed within the forward or left hand end of the portion 25 of the bobbin retainer, when the radially outer edge of the forward surface 33 of the main body 32 of the bobbin in engagement with an abutment flange having a transverse shoulder 37 on the forward end of part 25 of the bobbin retainer. A spline connection 44 is provided between the body 32 of the bobbin 31 and the forward portion 25 of part 24 to permit part 24 to shift longitudinally forwardly relatively to the bobbin 31 upon the operation of the inflator in its automatic mode as shown in FIG. 5.

The latching means is completed by a hollow stem 38 mounted coaxially of the bobbin retainer of the inflator, stem 38 having a radially outwardly directed annular flange 39 at its rear end, flange 39 being clamped between the forward end of the neck 21 of a $CO_2$ capsule 22 and an annular flange 40 which extends radially inwardly from the transverse portion 41 of the bobbin retainer 24 which connects parts 23 and 25 of the bobbin retainer. Adjacent to the forward end of the stem 38 there is a transverse annular surface 42 which is disposed in a manner which is complementary to the rear surfaces of the teeth 35 on the bobbin. It will be apparent that, so long as the water-sensitive ring 36 is intact, the fingers 34 remain in the position shown in FIGS. 2, 3, and 4 so that the teeth 35 thereon engage the surface 42 on stem 38 and prevent the travel of the bobbin retainer 24, the supporting sleeve 26, the hollow stem 38, and the $CO_2$ capsule 22 to the left, that is forwardly, relative to bobbin 31.

The stem 38, which in the embodiment shown is made of plastic material, has a longitudinal axial bore 45 therethrough. Centrally within such bore there extends a tubular piercing pin 46 having an external diameter substantially less than that of the bore 45. A feather-edged annular seal 47 extends radially inwardly and axially rearwardly from the inner surface of the stem 38 to engage the outer surface of the piercing pin 46. Because the annular sealing means 47 is a frustum of a cone which converges in a direction to the rear, an increase in fluid pressure rearwardly of the seal, which is at least slightly flexible, urges it more forcibly against the piercing pin 46 thereby to form an effective seal against gas leakage.

The stem 12, which is secured and sealed to the side wall 11 of an inflatable article, has a longitudinal slot 48 therein, such slot receiving the forward end of the hollow piercing pin 46. Thus the bore 13 in the portion 14 of the housing of the inflator can be circular cylindrical in shape, the forward end of the piercing pin which extends into the slot 48 in the stem acting as a key to prevent rotation of the stem 12 with respect to the housing part 14, 17. The forward end 52 of the piercing pin is molded in place in the portion 14 of the housing of the inflator, there being an enlargement 51 on the piercing pin, so that the piercing pin can sustain a forwardly directed thrust thereon when it pierces the seal 49 on the forward end of the neck 21 of the $CO_2$ capsule. The rear end of the piercing pin 46 is beveled and sharpened as shown at 50. When the $CO_2$ capsule 22 is thrust to the left by a coil compression spring 64, to be described more fully hereinafter, whether by operation of the inflator in the manual mode (FIG. 4) or the automatic mode (FIG. 5), the neck 21 of the $CO_2$ capsule is impaled upon the sharpened rear end of the piercing pin 46 so that the gas under pressure in the capsule flows into the interior of the piercing pin 46 and travels forwardly longitudinally thereof into the stem 12 and thence into the inflatable article 11.

Figure 6:
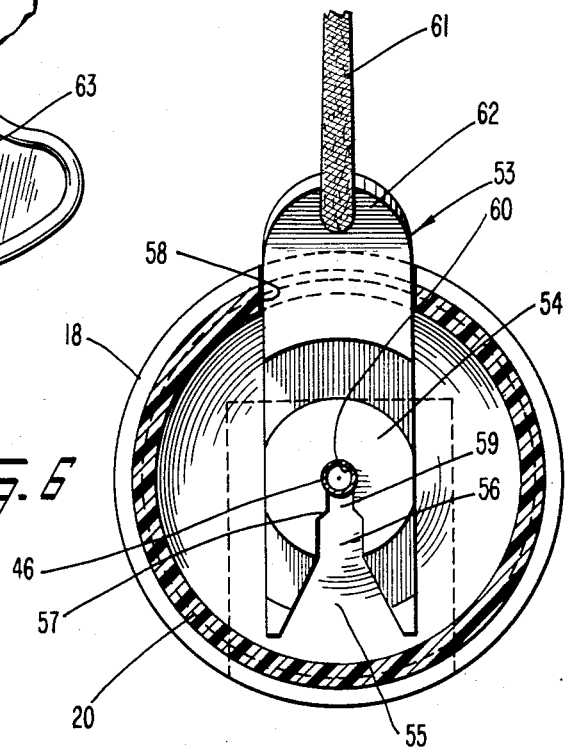
FIG. 6 is a view in section through the inflator, the section being taken along the line 6—6 in FIGS. 1 and 3.

As shown in FIGS. 2 and 3 in the ready-to-fire condition of the inflator, the forward surface 33 of body 32 of bobbin 31, thrust to the left by spring 64, engages a laterally withdrawable yoke or abutment 53. Yoke 53 has a forward surface which engages the central rear surface 57 of portion 14 of the housing part 17 and a rear surface 54 which engages the forward surface of the body 32 of the bobbin or latching member 31. The abutment or yoke 53, which is made of plastic material, has a bifurcated inner end the two legs of which are separated by a wide, funnel-shaped mouth 55, a first parallel sided passage 56, a narrowing passage 57, a narrow parallel sided passage 59, and a part-circular opening 60 the periphery of which subtends an angle somewhat greater than 180°, in that order. The passage 59 has a width, and the opening 60 has a diameter, which when the bifurcated end of the yoke is released, are somewhat smaller than the diameter of the piercing pin 46. When the yoke is in place, as shown in FIG. 6, the piercing pin is stably retained in opening 60, but the yoke may be removed by a purposeful pull upon it in an upward direction in FIG. 6.

A flexible lanyard 61 is secured to the upbent (FIG. 1) outer end 62 of the yoke 53, the lanyard being provided with a handle 64 so that it may be strongly pulled in a radially outward direction to remove the yoke 53 from the housing of the inflator when the inflator is operated in its manual mode.

The above-referred to coil compression spring 64 is telescoped about the rear end portion 23 of the bobbin retainer 24, the forward end of the spring being in engagement with the rear end surface 65 of the supporting sleeve 26, and the rear end of the spring being in engagement with the forward surface of the flange 66 on housing part 20. Integrally attached to the rear end of the sleeve portion 23 and coaxial thereof is a rear sleeve 69 having a radially outwardly extending flange 70 on its outer end, the radially outer edge of flange 70 radially overlapping the radially inner edge of the flange 66.

Using the $CO_2$ capsule 21 as a handle, assuming that the neck 22 thereof has been screwed into sleeve part 23, the parts of the inflator are further assembled by screwing part 25 into sleeve 26, impelling sleeve 26 to the rear (right), at first easily, and then against the continually increasing opposition of the coil compression spring 64. In FIGS. 2 and 3 the parts of the inflator are shown in positions they occupy when the inflator is ready for operation either manually or automatically.

MANUAL OPERATION

When it is desired to operate the inflator manually, with the parts thereof initially in the positions shown in FIGS. 2 and 3, the abutment or yoke 53 is withdrawn laterally from the opening 58 in the housing 17, 20 by pulling upon the handle 63 and thus the lanyard 61. After the removal of the yoke 53 from the housing, as depicted in FIG. 4, the spring 64 forces the supporting sleeve 26 and the stem 38 to the left, the engagement between the transverse surface 42 on the stem and the teeth 35 on the bobbin 31 carrying the bobbin with such parts to the left. All of such parts move to the left a distance which is equal to the axial thickness of the yoke or abutment 53, so that the sharpened rear end 50 of the piercing pin 46 punches a hole in the frangible seal 49 on the neck of the $CO_2$ capsule. The terminus of the forward travel of the various parts 24, 26, and 38 is determined by engagement between the surface 33 on the front end of the body 32 of the bobbin 31 and the surface 57 on the rear end of the central boss on part 17 of the housing.

AUTOMATIC OPERATION

This operation is depicted in FIG. 5. As above explained, in this operation the yoke 43 remains in place in the inflator. Forward travel of the stem 38 and the bobbin retainer 24 is now permitted because water entering into the housing through one or more passages in the rear end of the housing as shown at 72 causes the destruction of the water-destructible member 36 so that the fingers 34 are sprung radially outwardly and the stem 38 travels forwardly with respect to the body 32 of the bobbin. The spline connection 44 between the body 32 of the bobbin and the part 25 of the bobbin retainer permits the travel of the bobbin retainer to the left with respect to the bobbin 31 in this mode of operation.

The inflator of the invention is so constructed that it permits the fact that the inflator has been automatically operated to be quickly and accurately ascertained from the external appearance of the inflator. Obviously when the abutment or yoke 53 is absent, having been withdrawn as depicted in FIG. 4, it can readily be ascertained that the inflator has been operated manually and the contents of the $CO_2$ capsule have been discharged.

When the inflator has been either manually discharged (FIG. 4) or automatically discharged, as shown in FIG. 5, the $CO_2$ capsule 22 will have traveled axially forwardly to terminal positions in the housing of the inflator. In the terminal position of FIG. 4, the forward end surface 33 of the body 32 of the bobbin 31 abuts the rear end surface of the central boss on housing part 17. In the terminal position of FIG. 5, with the yoke or abutment 53 in place, the stem 38 has traveled forwardly sufficiently for its forward end to abut the rear end of the yoke or abutment 53. The fact that the inflator has been either manually or automatically operated will be indicated by the breaking away of the outer rim part 70' of the flange 70, as shown in both FIGS. 4 and 5. This occurs when flange 70 engages flange 66 as part 24 moves to the left. The outer rim part 70' may be initially attached to the central part of flange 70 by a weakened annular zone, if desired.

As indicated in the drawings, the parts of the housing of the inflator as well as those of the latching mechanism for automatic operation, and the removable abutment for manual operation, are preferably made of plastic material. A suitably strong shock-resistant plastic material, for example, may be an acetal resin, such as that marketed by DuPont under the trademark "DELRIN".

Although the invention is illustrated and described with reference to one preferred embodiment thereof, it is to be expressly understood that it is in no way limited to the disclosure of such preferred embodiment but is capable of numerous modifications within the scope of the appended claims.

I claim:

1. An automatic inflator which inflates gas-inflatable articles by the release of compressed gas from a gas-containing capsule by the piercing of a sealing means on the capsule, comprising an elongated housing having first and second end portions, the housing receiving the neck of a compressed gas-containing capsule for longitudinal movement with respect thereto and with the sealing means on the capsule disposed adjacent the second end portion of the housing, a piercing pin mounted in the first end portion of the housing to confront the sealing means of said capsule mounted in the housing, resilient means at the second end portion of the housing for constantly urging the capsule longitudinally of the housing toward the first end portion thereof, and a releasable blocking means within the housing and interposed between the sealing means-containing end of the capsule and said first end portion of the housing to hold the sealing means of the capsule spaced from the piercing pin, the blocking means including a water-sensitive means which when wet releases the blocking means so that the resilient means moves the capsule toward the piercing pin so that the sealing means of the capsule is pierced thereby, the blocking means comprising telescopically disposed inner and outer parts disposed with their axes aligned longitudinally of the housing, one of said inner and outer parts of the blocking means engaging the capsule and the other of said inner and outer parts of the blocking means being disposed in thrust transmitting relationship with the first end portion of the housing.

2. An automatic inflator which inflates gas-inflatable articles by the release of compressed gas from a gas-containing capsule by the piercing of a sealing means on the capsule, comprising an elongated housing having first and second end portions, the housing receiving the neck of a compressed gas-containing capsule for longitudinal movement with respect thereto and with the sealing means on the capsule disposed adjacent the second end portion of the housing, a piercing pin mounted in the first end portion of the housing and confronting the sealing means of said capsule mounted in the housing, resilient means at the second end portion of the housing for constantly urging the capsule longitudinally of the housing toward the first end portion thereof, and a releasable blocking means adjacent the second end portion of the housing and interposed between the sealing means-containing end of the capsule and said first end portion of the housing to hold the sealing means of the capsule spaced from the piercing pin, the blocking means including a water-sensitive means which when wet releases the blocking means so that the resilient means moves the capsule toward the piercing pin so that the sealing means of the capsule is pierced thereby, the blocking means comprising telescopically disposed inner and outer parts disposed with their axes aligned longitudinally of the housing, one of said inner and outer parts of the blocking means engaging the capsule and the other of said inner and outer parts of the blocking means being disposed in thrust transmitting relationship with the first end portion of the housing, and comprising a supporting means interposed between the said other of said inner and outer parts of the blocking means and the first end portion of the housing.

3. An automatic inflator according to claim 2, wherein the capsule has an externally-threaded neck portion, and the inner part of the blocking means is attached to the threaded portion of the capsule.

4. An automatic inflator according to claim 2, wherein the supporting means is a member which is manually removable from the housing, whereby the capsule and the blocking means move together toward the first end portion of the housing so that the piercing pin pierces the sealing means of the capsule.

5. An automatic inflator according to claim 2, wherein the housing has a first part including the first end portion, and a second end part including the second end portion, and means for demountably connecting the two parts of the housing together.

6. An automatic inflator according to claim 5, wherein the two parts of the housing are disposed in telescopic arrangement, and comprising a screw threaded connection between such two parts, the length of the screw threaded connection being such that the two parts of the housing may be initially engaged without placing the resilient means under any substantial stress.

7. An automatic inflator according to claim 2, wherein the inner part of the blocking means is attached to the capsule and the outer part of the blocking means is disposed in thrust transmitting relationship with the first end portion of the housing.

8. An automatic inflator according to claim 7, comprising a first, threaded sleeve at the second, rear end of the housing receiving the threaded neck of a gas-containing capsule, a second, blocking means retaining sleeve connected to the forward end of the first sleeve coaxial thereof and receiving the outer part of the blocking means therewithin, a third sleeve telescoped over the second sleeve, and a threaded connection between the second and third sleeves, means permitting the third sleeve to move longitudinally of the housing while preventing its rotation with respect thereto, and wherein the resilient means is a coil compression spring, said spring being held under compression between the rear end of the third sleeve and the second, rear portion of the housing.

9. An automatic inflator according to claim 7, wherein the inner part of the blocking means has a transverse surface thereon, and the outer part of the blocking means is in the form of a sleeve made up of a plurality of axially extending segments having teeth on the inner surface adapted releasably to engage the transverse surface on the inner part of the blocking means, the segments of the sleeve are mounted for being swung radially outwardly to free the teeth from engagement with the transverse surface, and a water-destructible ring is disposed around the segments to hold the teeth thereon in engagement with said transverse surface.

10. An automatic inflator according to claim 9, comprising means engaging the outer surface of the ring in locations between the segments of the sleeve to hold the ring in compression in the spans thereof between such means and successive segments of the sleeve.

* * * * *